United States Patent [19]

Rastogi et al.

[11] Patent Number: 4,601,766

[45] Date of Patent: Jul. 22, 1986

[54] LOW LOSS ELECTRICAL STEEL STRIP AND METHOD FOR PRODUCING SAME

[75] Inventors: Prabhat K. Rastogi; Grigory Lyudkovsky, both of Munster, Ind.

[73] Assignee: Inland Steel Company, Chicago, Ill.

[21] Appl. No.: 695,009

[22] Filed: Jan. 25, 1985

[51] Int. Cl.[4] ..... H01F 1/04

[52] U.S. Cl. ..... 148/111; 148/112

[58] Field of Search ..... 148/111, 112

[56] References Cited

U.S. PATENT DOCUMENTS

| | | | |
|---|---|---|---|
| 2,067,036 | 1/1937 | Wimmer | 148/111 |
| 2,142,347 | 1/1939 | Browne et al. | 148/112 |
| 2,535,420 | 12/1950 | Jackson | 148/111 |
| 3,042,556 | 7/1962 | Hemmeter | 148/111 |
| 3,415,696 | 12/1968 | Gimigliano | 148/111 |
| 3,960,616 | 6/1976 | Evans et al. | 148/111 |
| 3,971,678 | 7/1976 | Vlad et al. | 148/111 |
| 4,204,890 | 5/1980 | Irie et al. | 148/111 |
| 4,306,922 | 12/1981 | Coombs et al. | 148/111 |
| 4,390,378 | 6/1983 | Rastogi | 148/111 |
| 4,394,192 | 7/1983 | Rastogi | 148/120 |
| 4,421,574 | 12/1983 | Lyudkovsky | 148/111 |

FOREIGN PATENT DOCUMENTS

| | | | |
|---|---|---|---|
| 441775 | 1/1936 | United Kingdom | 148/111 |

OTHER PUBLICATIONS

BHP Tech. Bull., vol. 25, Nov., 1981, at pp. 25–30, an article entitled "Electrical Steels Produced by Vacuum Degassing and Continuous Casting".

*Primary Examiner*—John P. Sheehan

*Attorney, Agent, or Firm*—Marshall, O'Toole, Gerstein, Murray & Bicknell

[57] ABSTRACT

A cold-rolled steel strip having a combined silicon and aluminum content no greater than about 1.5 wt. % is subjected to processing including a continuous decarburization anneal after temper rolling. The strip is stamped into motor core laminations and stress relief annealed. The resulting lamination has magnetic properties comparable to a lamination having a much higher silicon and silicon plus aluminum content.

13 Claims, No Drawings

LOW LOSS ELECTRICAL STEEL STRIP AND METHOD FOR PRODUCING SAME

BACKGROUND OF THE INVENTION

The present invention relates generally to cold rolled steel strip from which is made the core of an electric motor, and more particularly to steel strip which imparts to the core a relatively low core loss and a comparatively high peak permeability.

An electric motor is composed of a stator surrounding a rotor. The stator is composed of wire made from a relatively high conductivity material, such as copper, wound on a core composed of steel. The steel core of an electric motor is made up of laminations fabricated from cold rolled steel strip, typically composed of silicon-containing steel, and the steel laminations impart to the core properties known as core loss and peak permeability which affect the power loss in the motor. Core loss, as the name implies, reflects power loss in the core. Peak permeability generally reflects power loss in the winding around the core. Core loss is expressed as watts per pound (W/lb.) or watts per kilogram (W/kg.). Peak permeability is expressed as Gauss per Oersted (G/Oe.). Permeability may also be described in terms of relative permeability in which case it is expressed without units although the numbers would be the same as the numbers for the corresponding peak permeability. Core loss and peak permeability are both measured for the magnetic induction at which the core is intended to operate. Magnetic induction is expressed as Tesla (T) or kilo-Gauss (kG). A typical magnetic induction is 1.5 T (15 kG).

Thus, core loss reflects the power loss due to the core at a given magnetic induction, e.g., 1.5 T (15 kG), and peak permeability reflects the magnetizing current in the material of the core at that given induction. The higher the peak permeability, the lower the magnetizing current needed to achieve a given induction. In addition, the higher the peak permeability for a given induction, the lower the power loss in the winding. Winding loss plus core loss are both important factors which reduce the efficiency of the motor.

Core loss and peak permeability are inherent properties of the steel strip from which the core laminations are fabricated. Therefore, an aim in producing steel strip for use in making the core of an electric motor is to reduce the core loss and increase the peak permeability of that steel strip, both of which factors increase the efficiency of the motor. Both of these factors are affected by the composition and heat treatment of the strip.

Moreover, for a steel having a given composition and heat treatment, core loss increases with an increase in the thickness of the strip rolled from that steel. Thus, comparisons of core loss should be made on steel strips having comparable thicknesses. For example, assuming a core loss of 5.10 W/kg (2.30 W/lb.) at a strip thickness of 0.018 inches (0.46 mm.), if there is then an increase in thickness of 0.001 inch (0.0254 mm.), the core loss will increase typically at an estimated rate of about 0.22 W/kg (0.10 W/lb.).

The considerations described above are discussed in Rastogi U.S. Pat. No. 4,390,378 etitled "Method for Producing Medium Silicon Steel Electrical Lamination Strip", and the disclosure thereof is incorporated herein by reference.

The steel strip disclosed in U.S. Pat. No. 4,390,378 is what is known as a semi-processed steel strip. More particularly, the final desired magnetic properties (core loss and average peak permeability) are not present in the steel when it is shipped by the steel mill to the customer who stamps out the laminations and then subjects the laminations to a decarburizing anneal as a result of which the final desired magnetic properties are produced. The resulting laminations have a 1.5 T (15 kG) average core loss value less than about 5.1 W/kg (2.30 W/lb.), and average peak permeability more than about 1,800 G/Oe. for a sample thickness of about 0.018 inch (0.46 mm.). This is accomplished with a steel composition which includes 0.85–1.05 wt. % silicon and 0.20–0.30 wt. % aluminum.

A possible drawback to the use of a semi-processed steel of the type described above is that it requires a decarburizing anneal by the customer which may be considered undesirable. A decarburizing anneal involves relatively stringent annealing requirements and consumes significant amounts of energy, the annealing being conducted at a temperature in the range 760°–843° C. (1,400°–1,550° F.) for about 1–2 hours. Moreover, there are sub-surface oxidation problems associated with a decarburization anneal conducted at this stage of the manufacturing operation.

An expedient for obtaining a lamination having the magnetic properties discussed above, and without requiring the customer to conduct a decarburizing anneal, is to employ a steel having a greater silicon and/or aluminum content, e.g., a combined silicon plus aluminum content in the range of about 1.85–2.40 wt. %. In contrast, the semi-processed steel of U.S. Pat. No. 4,390,378 has a combined silicon and aluminum content no greater than about 1.25 wt. %.

The steels with the higher silicon plus aluminum content are fully processed steels on which the customer conducts no decarburization operation after stamping out the laminations, but these steels have their own drawbacks. The higher the silicon content, the lower the saturation magnetization and the lower the magnetic permeabilty at high induction (≧1.5 T(15 kG)), and the greater the likelihood of cracking during reduction of the steel from a slab to a hot-rolled strip. The higher silicon content in the steel strip also reduces the life of the dies used to stamp out the laminations from the strip. As for aluminum, the higher the aluminum content, the greater the likelihood of producing a "dirty" steel, when employing conventional steel-making practices without vacuum degassing.

Thus, the prior art expedients for producing a steel lamination having the magnetic properties described above require either a relatively high silicon plus aluminum content, with its attendant drawbacks, or require the customer to employ a decarburization anneal in those instances where the silicon plus aluminum content is relatively low.

SUMMARY OF THE INVENTION

The present invention employs a method which produces a lamination with the desired magnetic properties utilizing the relatively low silicon plus aluminum content of Rastogi U.S. Pat. No. 4,390,378 but without employing a decarburizing anneal after stamping out the laminations.

More particularly, it is the aim of the present invention to produce a cold-rolled steel strip for use in electric motor core laminations having a 1.5 T (15 kG)

average core loss value less than about 5.3 W/kg (2.40 W/lb.) and average peak permeability in the range 1,600–1,900 G/Oe. for a sample thickness of about 0.018 inch (0.46 mm.). This is accomplished by utilizing a combination of steel chemistry and steel processing techniques, to be described in detail below.

Generally, the steel composition includes 0.8–1.1 wt. % silicon and 0.20–0.40 wt. % aluminum. The carbon content is about 0.02 wt. % max. before processing. The molten steel may be either ingot cast or continuously cast, and both should provide the desired properties.

The cast steel is then hot-rolled, coiled, pickled and cold-rolled employing essentially conventional techniques.

After cold-rolling, the steel strip is subjected to a first continuous anneal at a strip temperature in the range 800°–900° C. (1,472°–1,652° F.) for at least about 45 seconds and then allowed to cool. The strip is then temper rolled to produce a reduction of about 4–9%. After temper rolling, the strip is subjected to a second continuous anneal, in a decarburizing atmosphere, at a strip temperature in the range 800°–900° C. (1,472°–1,652° F.) for at least about 45 seconds. This reduces the carbon content of the strip to no greater than 0.007 wt. %. The maximum time for the second continuous anneal is limited to avoid excessive grain growth to a ferritic grain size number below about ASTM 3.

At the conclusion of the second continuous anneal, the steel strip is ready to be shipped to a customer. At this stage, the steel strip has a 1.5 T (15 kG) average core loss less than 5.3 W/kg (2.4 W/lb.) and average peak permeability in the range 1,100–1,300 G/Oe. for a thickness of 0.018 inch (0.46 mm.). Also at this stage, the strip has a magnetic texture characterized by a relatively large volume fraction of the most preferred crystallographic orientation and a relatively low volume fraction of the least preferred crystal-lographic orientation.

The customer stamps laminations from the steel strip, without conducting any further decarburizing operation on either the strip or the laminations. Should the customer desire to substantially increase the average peak permeability of the laminations, the customer may then, after the stamping step, subject the laminations to a stress relief anneal at a temperature greater than 550° C. (1,022° F.), in a non-decarburizing atmosphere. This increases the average peak permeability to a value in the range 1,600–1,900 G/Oe., without any substantial change in grain size or magnetic texture while maintaining the core loss value no greater than it was before the stamping and box annealing steps. Typically, the stress relief anneal is conducted for no longer than about one hour.

The first continuous anneal to which the cold-rolled strip is subjected may be in a non-decarburizing atmosphere or it may be in a decarburizing atmosphere. When a decarburizing atmosphere is employed in the first continuous anneal, the carbon content of the steel strip at the time it is shipped to the customer is a bit lower, e.g., no greater than about 0.005 wt. %, than when only the second continuous anneal was conducted in a decarburizing atmosphere. In addition, when both continuous anneals are conducted in a decarburizing atmosphere, the core loss value is a bit lower, e.g., 5.1 W/kg (2.3 W/lb.). The two annealing steps to which the cold-rolled steel strip is subjected must be continuous. Box annealing is not permissible.

In those situations where the customer opts not to box anneal after stamping, the steel strip may be provided to the customer in a coated condition, e.g., coated with an inorganic coating such as a monoaluminum phosphate type coating, or coated with an organic coating such as a varnish-type paint.

A cold-rolled steel strip in accordance with the present invention may also be used as the material from which is fabricated cores for small transformers (e.g., ballast-type transformers).

The magnetic properties of the cold rolled steel strip and of the laminations reflect the relatively large grain size and magnetic texture which in turn reflect the steel composition and the processing to which the steel was subjected.

Other features and advantages are inherent in the method and products claimed and disclosed or will become apparent to those skilled in the art from the following detailed description.

DETAILED DESCRIPTION

In accordance with an embodiment of the present invention, there is provided a steel having substantially the following initial chemistry, in weight percent.

| Element | Range |
|---|---|
| Carbon | .02 max. |
| Manganese | .45–.70 |
| Silicon | .8–1.1 |
| Aluminum | .20–.40 |
| Phosphorus | .1 max. |
| Sulfur | .01 max |
| Nitrogen | .007 max |
| Iron | Essentially the balance |

Molten steel having a chemistry within the range set forth above is produced in a basic oxygen furnace, for example. The metal is desulfurized upstream of the basic oxygen furnace or in a ladle after the basic oxygen furnace. The molten steel is then ingot cast or continuously cast, followed by a hot-rolling operation which employs essentially conventional techniques. The hot-rolling operation employs a slab reheat temperature in the range 2,100°–2,300° F. (1149°–1260° C.), typically 2,200° F. (1204° C.). The hot-roll finishing temperature is in the range 1,650°–1,750° F. (899°–954° C.), preferably 1,700° F. (927° C.). Coiling is conducted at a temperature in the rage 1,300°–1,400° F. (704°–760° C.), preferably 1,350° F. (732° C.). The hot-rolled steel strip has a thickness typically in the range 0.08–0.10 inches (2–2.5 mm.).

The hot-rolled strip is then subjected to a conventional pickling operation following which the strip is cold-rolled to a thickness in the range 0.019–0.025 inches (0.48–0.64 mm.). The cold-rolled steel strip is then subjected to a first continuous anneal at a strip temperature in the range 800°–900° C. (1,472°–1,652° F.), preferably 850° C. (1,562° F.), for at least about 45 seconds (e.g., one minute), following which the strip is allowed to cool. The first continuous anneal may be either non-decarburizing or decarburizing. In either case, the atmosphere may contain 6% hydrogen and 94% nitrogen. This atmosphere may be either non-decarburizing or decarburizing, depending upon the dew point. For a typical non-decarburizing atmosphere, the dew point is −40° C. (−40° F.). For a typical decarburizing atmosphere, which is oxidizing toward carbon but reducing toward iron, the dew point should be about +18° C. (64° F.). The non-decarburizing (dry) atmosphere should be reducing to both carbon and iron.

Following the first continuous anneal, the strip is temper rolled to produce a reduction of about 4–9% (6–7% preferred).

After the temper rolling step, the steel strip is subjected to a second continuous anneal at a strip temperature in the range 800°–900° C. (1,472°–1,652° F.), preferably 850° C. (1,562° F.), for at least about 45 seconds (e.g., one minute). The maximum time for which the steel strips subjected to the annealing temperature is determined by a need to avoid excessive ferritic grain growth and a need to avoid too much softening which interferes with the subsequent stamping operation. At the conclusion of the second continuous anneal, the steel strip should have a ferritic grain size number no less than about ASTM 3 and a hardness no lower than about 45 on the Rockwell B scale (e.g., 48–52 $R_B$). The decarburizing atmosphere for the second continuous anneal may be the same as that described above in connection with the first continuous anneal when that step employs a decarburizing atmosphere.

After the second continuous anneal, the steel strip has a magnetic texture characterized by a relatively large pole density (e.g., 1.7) of the most preferred crystallographic orientation, {100}, and a relatively low pole density (e.g., 1.1) of the least preferred crystallographic orientation, {111}.

The carbon content of the steel strip, which was about 0.02 wt. % max. at the beginning of the processing described above, is no greater than 0.007 wt. % at the conclusion of the second continuous anneal; and, if a decarburizing atmosphere is employed during both continuous annealing steps, the carbon content at the conclusion of processing is typically no greater than 0.005 wt. %.

The ferritic grain size number, after the second continuous anneal, is preferably in the range 3.5–4.5 ASTM.

The magnetic properties of the strip, at the conclusion of the second continuous anneal, include a 1.5 T (15 kG) average core loss less than 5.3 W/kg (2.4 W/lb.) and average peak permeability in the range 1,100–1,300 G/Oe., for a thickness of about 0.018 inches (0.46 mm), at a frequency of 60 Hertz. When a decarburizing atmosphere is employed for both continuous annealing steps, the core loss is a bit less, i.e., 5.1 W/kg (2.3 W/lb.).

With respect to the composition of the steel, the various constituents thereof should be controlled in the manner described below. The carbon content should be no greater than 0.02 wt. % because, if the carbon content is higher, it cannot be sufficiently decarburized, during processing, to provide the desired properties; and too high a carbon content would interfere with grain growth to the desired ferritic grain size which should be relatively large (but not too large, as described herein).

The manganese content should be a minimum of 0.45 wt. % in order to impart to the steel strip the desired electrical resistivity. The maximum manganese content of 0.70 wt. % is dictated by economic factors.

The minimum silicon content should be 0.8 wt. % in order to impart to the steel strip the desired electrical resistivity. The maximum silicon content, 1.1 wt. %, is selected to avoid certain adverse effects resulting from large amounts of silicon. For example, large amounts of silicon can cause cracking of the steel, originating during slabbing and manifesting itself during subsequent hot-rolling steps. Limiting the silicon to about 1.1 wt. % max. produces a higher yield of steel at all stages of the hot reduction processing of the steel, beginning at the slabbing stage and continuing through the coiling of the hot-rolled strip. Limiting the silicon content of the steel strip to 1.1 wt. % also improves the life of dies used by the customer for stamping out laminations from the steel strip, compared to die life using steel strip containing substantially larger silicon contents.

Silicon is the best ingredient for imparting electrical resistivity to the steel. Aluminum is the next best. By combining aluminum with silicon, the silicon content can be lower than what it would have been in the absence of aluminum, without losing the desired electrical resistivity. Aluminum does not have the adverse effect on die life that silicon does, and aluminum does not adversely affect steel yield during hot-rolling like silicon does.

A minimum aluminum content of 0.20 wt. %, when combined with the silicon content described above, imparts to the steel an electrical resistivity equivalent to that supplied by a silicon content higher than that required in accordance with the present invention. The maximum aluminum content of 0.40 wt. % is selected to prevent the steel from becoming too "dirty", when conventional steel-making practices are employed. This would not be a problem if the steel-making practice involved vacuum degassing.

The combined silicon plus aluminum content is no greater than 1.5 wt. % in accordance with the present invention which employs a "lean" chemistry to produce a steel strip having magnetic properties equivalent to a steel having a much higher silicon and silicon plus aluminum content (e.g., 1.8 wt. %–2.4 wt. % silicon plus aluminum). With the lean composition of the present invention (1.5 wt. % max. silicon plus aluminum) together with the special processing techniques described herein, one may achieve magnetic properties comparable to those present in a steel having the higher silicon plus aluminum contents required by the prior art (i.e., 1.8–2.4 combined wt. %).

Sulfur and nitrogen are maintained at 0.01 wt. % max. and 0.007 wt. % max., respectively, to avoid certain adverse effects on the properties of the steel usually attributable to these two impurities, including an adverse effect on the magnetic properties. Nitrogen and nitride formers have an adverse effect on peak permeability in that they "dirty" the steel (particularly titanium and zirconium nitrides), a clean steel being desirable for increased peak permeability. In addition, vanadium, columbium and possibly tantalum will retard grain growth, preventing the finished, cold-rolled steel strip as processed herein and the laminations from achieving the desired 3.0–4.5 ASTM ferritic grain size number otherwise achievable in accordance with the present invention.

The sulfur maximum of 0.01 wt. % is dictated by a desire to minimize sulfide inclusions, such as manganese sulfide, which increase core loss.

The phosphorus content is maintained at 0.1 wt. % max. to avoid adverse effects such as brittleness usually attributable to phosphorus when it is present in steel in larger amounts.

Cold-rolled steel strip having the composition described above and which has undergone the processing described above, including decarburization, has the properties described above, and the strip is shipped to a customer in that condition. The customer then stamps out the laminations from the strip and assembles the laminations into a motor core (or into a small transformer core) either without further processing, or, optionally, the customer may subject the laminations to a stress relief anneal. The stress relief anneal is conducted at a temperature greater than 550° C. (1,022° F.), in a non-decarburizing atmosphere, to increase the average peak permeability substantially, without any substantial change in grain size or magnetic texture while maintaining the core loss value no greater than what it was before the stress relief anneal.

More particularly, the average peak permeability is increased by the stress relief anneal from 1,100–1,300 G/Oe to 1,600–1,900 G/Oe. In addition, the average core loss value may be reduced a bit by the stress relief anneal from 5.1 W/kg (2.3 W/lb.) to no greater than 4.6 W/kg (2.1 W/lb.), for a steel strip which was subjected to decarburizing during both of the continuous annealing steps. For a steel strip which was subjected to a decarburizing atmosphere during only the second of the two continuous annealing steps, the core loss value after the stress relief anneal may be slightly higher, e.g., a reduction from 5.3 W/kg (2.4 W/lb.) at the conclusion of the second continuous annealing step to no greater than 4.8 W/kg (2.2 W/lb.) after the stress relief anneal.

A typical stress relief anneal is conducted at a temperature of 650° C. (1202° F.) for a time of about one hour in a conventional heat treating furnace (e.g., a gas fired, radiant tube furnace), although the time may be much shorter when an induction furnace is employed.

There is an improvement in magnetic properties (particularly average peak permeability) resulting from the stress relief anneal. The microstructure of the steel laminations (and of the cold-rolled strip from which the laminations were stamped) consists essentially of ferrite grains having an average ferritic grain size number larger than 3.0 ASTM (e.g., 3.5–4.5 ASTM).

The desirable properties inherent in the cold-rolled steel strip and the laminations stamped therefrom are the direct result of the combination of the composition and processing techniques described above.

Set forth below, in TABLE II, is a comparison of various properties of steel strip and steel laminations prepared in accordance with the present invention and of prior art steel strips and laminations. The composition, in wt. %, for all of the steels, except No. 7, are set forth below in TABLE I.

TABLE I

| C | Mn | Si | S | Al | N |
|---|---|---|---|---|---|
| 0.017 | 0.55 | 1.04 | 0.009 | 0.26 | 0.006 |

In TABLE II, the processing for steels 1 and 2 reflects cold-rolled steel strips prepared in accordance with the present invention, the processing for steels 3 and 4 reflects laminations prepared in accordance with the present invention, and the processing for steels 5–6 reflects the prior art. More particularly, steel 5 reflects a cold-rolled steel strip in accordance with Rastogi U.S. Pat. No. 4,398,378, and steel 6 reflects a lamination in accordance with said Rastogi '378 patent. Steel 7 reflects a commercial steel known as M-43, which is a fully processed, cold-rolled steel strip containing 2.35 wt. % silicon plus aluminum. All magnetic properties are for a steel thickness of 0.46 mm (0.018 in.) and for 1.5 T (15 kG).

TABLE II

| | 15 kG Magnetic Properties, Grain Size and Carbon Content | | | | |
|---|---|---|---|---|---|
| Steel No. | Processing | Core Loss (W/lb.) | Permeability (G/Oe.) | Grain Size (ASTM No.) | Initial C(%)/Final C (%) |
| 1. | A + T/R + B | 2.37 | 1200 | 4.2 | 0.017/0.007 |
| 2. | B + T/R + B | 2.36 | 1150 | 3.9 | 0.017/0.005 |
| 3. | A + T/R + B + C | 2.10 | 1820 | 4.1 | 0.017/0.006 |
| 4. | A + T/R + B + C | 2.10 | 1780 | 3.9 | 0.017/0.005 |
| 5. | A + T/R + D | 2.00 | 1850 | 3.8 | 0.017/0.004 |
| 6. | A + T/R + D + C | 2.02 | 1830 | 3.8 | 0.017/0.004 |
| 7. (M-43) | N.A. | 2.25 (typical) | 1100 | N.A. | N.A. |

A Continuous anneal, non-decarburizing (about 52 secs. at 850° C., dew point −40° C.)
B Continuous anneal, decarburizing (about 52 secs at 850° C., dew point +18° C.)
C Stress relief anneal, after stamping (1 hour soak time at 650° C., dew point < −40° C.)
D Decarburization anneal after stamping (790° C. for 1¼ hours, dew point +18° C.)
T/R Temper rolling
N.A. Not available It is apparent from the magnetic properties for steels 1 and 2 that the use of either a non-decarburizing or a decarburizing continuous anneal, prior to temper rolling, produces comparable magnetic properties in cold-rolled steel strip. This indicates that either type of continuous anneal is suitable for the development of a good quality product. In addition, the cold-rolled strip of both steels 1 and 2 is at least equivalent to the M-43 steel grade (steel 7) in terms of average peak permeability; however, core loss is slightly higher for steel strips 1 and 2.

The magnetic texture for steels 1 to 5 is shown in Table III.

TABLE III

| | Pole Densities, $(I/I_R)_{hkl}$, of Various Orientations {hkl} | | | | | | | |
|---|---|---|---|---|---|---|---|---|
| | Planes | | | | | | | |
| Steel | 200 | 211 | 220 | 310 | 222 | 321 | 420 | 332 |
| 1. | 1.63 | 0.96 | 1.03 | 1.18 | 0.99 | 1.00 | 1.09 | 0.94 |
| 2. | 1.71 | 0.97 | 0.99 | 1.14 | 1.10 | 0.98 | 1.16 | 0.88 |
| 3. | 1.58 | 0.95 | 1.18 | 1.08 | 0.95 | 0.89 | 0.94 | 0.98 |
| 4. | 1.65 | 1.06 | 1.09 | 0.94 | 1.16 | 0.93 | 0.96 | 0.97 |
| 5. | 1.62 | 1.00 | 1.23 | 1.08 | 1.11 | 0.84 | 1.08 | 0.81 |

Note:
$(I/I_R)_{hkl} = \frac{1}{3}[(I/I_R)S + (I/I_R)\frac{1}{4}D + (I/I_R)\frac{1}{2}D]_{hkl}$ where S, ¼ D and ½ D represent measurements made at surface, quarter depth and half depth sample position, respectively.
$(I/I_R)_{hkl}$ refers to the intensity of a given orientation of the sample divided by the intensity of the same orientation for a powder random sample.

TABLES II and III indicate that, despite similar texture and grain size, the semi-processed, decarburized lamination of steel 5 shows substantially better magnetic properties than the fully processed strips of steels 1 and 2. However, after undergoing stamping and a stress relief anneal in accordance with the present invention, the magnetic properties of the laminations, reflected by steels 3 and 4, approach that of the semi-processed, decarburized laminations of steels 5 and 6. The benefits associated with a stress relief anneal in accordance with the present invention were not observed when that stress relief anneal was applied to the semi-processed, decarburized laminations of steels 5 and 6. This was because a steel lamination in accordance with the present invention undergoes mechanical deformation after decarburization annealing whereas the semi-processed, decarburized lamina-tions reflected by steels 5 and 6 undergo mechanical deformation before decarburization annealing. As shown by the tables, the magnetic texture (TABLE III) and grain size (TABLE II) of steels 1-2 are unaffected by the stress relief anneal (note steels 3-4).

The results reflected by TABLES II and III suggest that a steel in accordance with the present invention can be used in two ways by customers: (a) a low-loss, fully-processed product useful as a replacement for M-43 steel grade (silicon plus aluminum of about 2.35 wt. %) and (b) a substitute for the semi-processed, decarburized product reflected by steels 5 and 6. In the case of alternative (a), the customer will conduct no stress-relief anneal after stamping, and the cold-rolled steel strip may be coated, before shipment to the customer, with an inorganic or organic-type coating. Alternative (b) has the advantage of eliminating the customer's need to conduct a decarburiza-tion anneal which requires a high degree of control to minimize sub-surface oxidation in order to achieve high permeability.

The foregoing detailed description has been given for clearness of understanding only, and no unnecessary limitations should be understood therefrom, as modifications will be obvious to those skilled in the art.

What is claimed:

1. In a method for producing cold rolled, steel strip useful in electric motor core laminations, the steps of:

providing a steel consisting essentially of the following composition in wt. %:
carbon: 0.02 max.
manganese: 0.45-0.70
silicon: 0.8-1.1
aluminum: 0.20-0.40
phosphorus: 0.1 max.
sulfur: 0.01 max.
nitrogen: 0.007 max.
iron: essentially the balance;
hot rolling said steel into steel strip;
coiling said hot rolled steel strip;
cold rolling said steel strip;

subjecting said steel strip to a first continuous anneal at a strip temperature in the range 800°-900° C. (1472°-1652° F.) for at least about 45 seconds, and then allowing said strip to cool;

temper rolling said strip to produce a reduction of about 4-9%;

and then, after said temper rolling step and before any stamping step, subjecting said steel strip to a second continuous anneal, in a decarburizing atmosphere, at a strip temperature in the range 800°-900° C. (1472°-1652° F.) for at least about 45 seconds up to a maximum time limit which avoids grain growth to a ferritic grain size number below about ASTM 3, to reduce the carbon content of the strip to no greater than 0.007 wt. %;

whereby said steel strip, after said second continuous anneal, has a 1.5 T (15 kG) average core loss less than 5.3 W/kg (2.4 W/lb.) and average peak permeability in the range 1100-1300 G/Oe., for a thickness of 0.018 in. (0.46 mm).

2. In a method as recited in claim 1 wherein:

said first continuous anneal is conducted in a decarburizing atmosphere;

and said average core loss of said strip after said second continuous anneal is less than 5.1 W/kg (2.3 W/lb.).

3. In a method as recited in claim 2 wherein:

said strip is decarburized, during said second continuous anneal, to a carbon content no greater than 0.005 wt. %.

4. In a method as recited in claim 3 wherein:

said strip has a ferritic grain size number, after said second decarburizing step, in the range 3.0-4.5 ASTM.

5. In a method as recited in claim 1 wherein:

said strip has a magnetic texture, after said second continuous anneal, characterized by a relatively large pole density of the most preferred crystallographic orientation and a relatively low pole density of the least preferred crystallographic orientation.

6. In a method as recited in claim 5 wherein:

said strip has a ferritic grain size number, after said second continuous anneal, in the range 3.0-4.5 ASTM.

7. In a method as recited in claim 1 wherein:

said strip has a hardness, after said second continuous anneal, no lower than about 45 on the Rockwell B scale.

8. In a method as recited in claim 1 wherein:

said strip is cold rolled to a thickness of 0.48-0.63 mm (0.019-0.025 in.), before said first continuous anneal.

9. In combination with the method steps recited in claim 1, the additional step for producing laminations, said additional step comprising:

stamping laminations from said steel strip after the latter has been subjected to said second continuous anneal, without any further decarburizing of either said strip or said laminations.

10. In combination with the method steps recited in claim 1, the additional method steps for producing laminations, said additional steps comprising:

stamping laminations from said steel strip after the latter has been subjected to said second continuous anneal;

and then, after said stamping step, subjecting said laminations to a stress relief anneal at a temperature greater than 550° C. (1022° F.), in a non-decarburizing atmosphere, to increase said average peak permeability substantially, without any substantial change in grain size or magnetic texture while maintaining said core loss value no greater than what it was before said additional steps.

11. In a method as recited in claim 10 wherein:

said laminations, after said stress relief anneal, have an average peak permeability in the range 1600-1900 G/Oe, for a thickness of 0.018 in. (0.46 mm).

12. In a method as recited in claim 10 wherein:

said first continuous anneal is conducted in a decarburizing atmosphere;

and said average core loss after said stress relief anneal is no greater than 4.6 W/kg (2.1 W/lb.).

13. In a method as recited in claim 10 wherein:

said stress relief anneal is conducted for no longer than about 1 hour.

* * * * *